US007240767B2

(12) United States Patent
Nakagawa

(10) Patent No.: US 7,240,767 B2
(45) Date of Patent: Jul. 10, 2007

(54) FIXING STRUCTURE OF TAIL PIPE OF EXHAUST PIPE

(75) Inventor: Yukihiro Nakagawa, Kasugai (JP)

(73) Assignee: Nakagawa Sangyo Co., Ltd., Nishikasugai (JP)

( * ) Notice: Subject to any disclaimer, the term of this patent is extended or adjusted under 35 U.S.C. 154(b) by 435 days.

(21) Appl. No.: 10/824,348

(22) Filed: Apr. 15, 2004

(65) Prior Publication Data

US 2005/0103565 A1 May 19, 2005

(30) Foreign Application Priority Data

Nov. 19, 2003 (JP) ..... 2003-389588
Feb. 25, 2004 (JP) ..... 2004-048947

(51) Int. Cl.
*F01N 7/08* (2006.01)
*F01N 7/18* (2006.01)

(52) U.S. Cl. ..... 181/227; 181/243; 12/194

(58) Field of Classification Search ..... 181/227, 181/228, 241, 243; D12/194
See application file for complete search history.

(56) References Cited

U.S. PATENT DOCUMENTS 1,173,801 A * 2/1916 Hess ..... 239/289
D112,482 S * 12/1938 Koch ..... D12/194
D158,848 S * 6/1950 Follen ..... D12/194
D162,112 S * 2/1951 Baker ..... D12/194
2,667,372 A * 1/1954 Gardner ..... 285/148.23
D177,877 S * 5/1956 Sandler ..... D12/194
D183,145 S * 7/1958 Russell ..... D12/194
2,858,853 A * 11/1958 Lyon ..... 239/601
2,864,406 A * 12/1958 Schewel ..... 239/505
2,868,228 A * 1/1959 Russell ..... 239/505
2,868,229 A * 1/1959 Russell ..... 239/132.3
2,891,580 A * 6/1959 Powers ..... 285/420
2,919,720 A * 1/1960 Nicholls ..... 239/517
3,016,692 A * 1/1962 Arnaldo et al. ..... 417/171
D247,360 S * 2/1978 Hamaguchi et al. ..... D12/194
4,323,139 A * 4/1982 Baldwin ..... 181/263
6,006,859 A * 12/1999 Hussaini ..... 181/227

FOREIGN PATENT DOCUMENTS

JP A 7-102967 4/1995

* cited by examiner

*Primary Examiner*—Edgardo San Martin
(74) *Attorney, Agent, or Firm*—Oliff & Berridge, PLC

(57) ABSTRACT

A clamping member (2) for clamping a periphery of a rear-end open portion of an exhaust pipe (3) is accommodated in a front-end open portion (11) of a tail pipe (1). The clamping member (2) has a pair of plate parts (21, 22) disposed at right and left positions of the front-end open portion (11) and a bolt (4) for connecting the plate parts (21, 22) to each other by reducing an interval between the opposed plate parts enough to sandwich a periphery of the rear-end open portion (31) between the plate parts. A concave surface (21*a*, 22*a*) whose configuration conforms to that of a periphery of the rear-end open portion (31) inserted between the plate parts (21, 22) is formed on each of the plate parts (21, 22).

5 Claims, 6 Drawing Sheets

RELATED ART

RELATED ART

FIXING STRUCTURE OF TAIL PIPE OF EXHAUST PIPE

This nonprovisional application claims priority under 35 U.S.C. § 119(a) on Patent Application Nos. 2003-389588, 2004-048947 filed in Japan, the entire contents of which are hereby incorporated by reference.

BACKGROUND OF THE INVENTION

1. Field of the Invention

The present invention relates to a construction for mounting a tail pipe on a rear-end opening of an exhaust pipe to improve the external appearance of the tail pipe.

2. Description of the Related Art

In mounting the tail pipe on the rear end of the exhaust pipe, the construction shown in FIGS. 8 and 9 is frequently used. That is, the approximately U-shaped receiving member 51 open downward is provided on the top portion of the inner peripheral surface of the front-end open portion 11 of the tail pipe 1 having a larger diameter than the exhaust pipe 3. The weld nut 52 is provided at the left and right positions of the bottom portion of the peripheral surface of the front-end open portion 11. The bolt 53 screwed into the weld nut 52 is penetrated into the tail pipe 1. The receiving member 51 is brought into contact with the top portion of the peripheral surface of the rear-end open portion 31 of the exhaust pipe 3 having a smaller diameter than the exhaust pipe 3, having a smaller diameter than the exhaust pipe 3, inserted into the tail pipe 1. At the same time, the tip of each of the bolts 53 penetrated into the pipe 1 is brought into contact with the left and right positions of the bottom portion of the peripheral surface of the rear-end open portion 31. Thereby the tail pipe 1 clamping the exhaust pipe 3 extending approximately horizontally is mounted at the rear end of the exhaust pipe 3 on an extension portion of the exhaust pipe 3, with the tail pipe 1 taking the same posture as that of the exhaust pipe 3. This mounting construction is disclosed in Japanese Patent Application Laid-Open No. 7-102967.

In the tail pipe-mounting construction shown in FIG. 10, the diameter of the front-end open portion 13 of the tail pipe 1 is gradually reduced toward the exhaust pipe 3, and the front-end opening of the tail pipe 1 is welded to the rear-end opening of the exhaust pipe 3.

In the construction of the former prior art, the tail pipe 1 is mounted on the exhaust pipe 3 by sandwiching the exhaust pipe 3 with the tips of the bolts 3 and the receiving member 51. Thus the construction of the prior art has a problem that the bolts 53 are loosened owing to vibrations and is hence unreliable in keeping the tail pipe 1 stably fixed to the exhaust pipe 3.

In the construction of the latter prior art 2, it is possible to prevent reduction of reliability in keeping the tail pipe 1 stably fixed to the exhaust pipe 3, because there is no problem of the loosening of the bolt. However, this prior art has a problem that a welded portion rusts because of high temperatures of an exhaust gas and the influence of injury from salt and thus the external appearance of the tail pipe 1 looks poor. To mount the tail pipe 1 horizontally on the tilted exhaust pipe 3, as shown in FIG. 11, it is necessary to divide the tail pipe 1 into the horizontal cylindrical pipe body 14 and the connection cylinder 15 and weld the inclined connection cylinder 15 whose diameter is decreased gradually toward the exhaust pipe 3 to the exhaust pipe 3 and the pipe body 14 to connect the connection cylinder 15 to the tail pipe 1 and the exhaust pipe 3. Therefore it is unavoidable that the construction of the conventional art 2 is complicated and the manufacturing cost becomes high.

SUMMARY OF THE INVENTION

The present invention has been made to solve the above-described problems. Therefore it is an object of the present invention to provide a tail pipe-mounting construction which does not deteriorate in reliability in keeping the tail pipe stably fixed to the exhaust pipe nor in its external appearance and which can be manufactured at a low cost.

To achieve the object, in the first invention, there is provided a mounting construction for mounting a tail pipe (1, 6), on an exhaust pipe (3) at a rear-end open portion (31) thereof, having a diameter larger than that of the rear-end open portion (31). The mounting construction includes a clamping means (2, 62, 63), for clamping a periphery of the rear-end open portion (31) of the exhaust pipe (3), formed in a front-end open portion (11, 61) of the tail pipe (1, 6). According to the first invention, the tail pipe is mounted on the exhaust pipe at its rear end by sandwiching the periphery of the rear-end open portion of the exhaust pipe with the clamping means provided at the front-end open portion of the tail pipe. Therefore the tail pipe-mounting construction has improvement in reliability in keeping the tail pipe stably fixed to the exhaust pipe. Further because the tail pipe-mounting construction does not have a connection portion to be welded, there is no fear of generation of rust on the connection portion. Thus there is no problem of deterioration of the external appearance of the tail pipe.

In the second invention, the clamping means of the constructions described in the first invention has a pair of plate parts (21, 22, 62, 63) disposed at right and left positions of the front-end open portion (11, 61) and a connection member (23, 4, 64, 65) for connecting the plate parts to each other by reducing an interval between the opposed plate parts enough to sandwich a periphery of the rear-end open portion (31) between a pair of the plate parts.

In the third invention according to the second invention, a concave surface (21*a*, 22*a*, 62*a*, 63*a*) whose configuration conforms to that of a periphery of the rear-end open portion (31) which is inserted between the plate parts (21, 22, 62, 63) is formed on each of the plate parts (21, 22, 62, 63). According to the third invention, because the peripheral surface of the rear-end open portion of the exhaust pipe can be sandwiched between the concave surfaces, it is possible to prevent the state of the tail pipe mounted on the exhaust pipe from being deteriorated by vibrations.

In the fourth invention according to the third invention, an axis (x2) of the concave surface (21*a*, 22*a*) formed on the right and left plate parts (21, 22) respectively is tilted with respect to an axis (x1) of the tail pipe (1). According to the fourth invention, even when the exhaust pipe has an inclination with respect to the tail pipe, the concave surfaces are formed on both plate parts with the axis of the concave surfaces tilting in a predetermined amount with respect to the axis of the tail pipe. Thereby the tail pipe can be mounted horizontally on the tilted exhaust pipe. This construction eliminates the need for forming a connection cylinder that is required in a conventional tail pipe-mounting construction. Therefore the tail pipe-mounting construction of the present invention can be manufactured at a low cost.

In the fifth invention according to any one of the first through the fourth invention, the clamping means is composed of a clamping member (2), separate from the tail pipe (1), accommodated inside the front-end open portion (11) and sandwiching a periphery of the rear-end open portion (31) of the exhaust pipe (3). According to the fifth present invention, since the clamping member is accommodated in the tail pipe, no projected portions interfering with obstacles are formed on the tail pipe.

In the sixth invention according to any one of the first through the fourth invention, a peripheral wall of the front-end open portion (61) is so shaped that the clamping means is capable of clamping a periphery of the rear-end open portion (61) of the exhaust pipe (3).

In the seventh invention according to the fifth invention, both ends of the one plate part are fixed to an inner peripheral wall of the front-end open portion. Further one end of the other plate part is fixed to the inner peripheral wall of the front-end open portion. The other end of the other plate part formed as a free end thereof is connected to the one plate part with a connection member.

In the eighth invention according to the sixth invention, one plate part is formed by bending a portion of the peripheral wall of the front-end open portion. On the other hand, the other plate part is separated from the peripheral wall of the front-end open portion except one end of the other plate part by a cut-out formed on the peripheral wall with the separated other end of the other plate part serving as a free end in connection with the one plate part by the connection member.

In the ninth invention according to the seventh invention, the connection member has a nut and a bolt screwed into the nut. The bolt is inserted into the tail pipe from an open portion formed on a peripheral surface of the tail pipe in penetration therethrough.

The reference letters and numerals in the parentheses correspond to the means described in the embodiments respectively.

As described above, the tail pipe-mounting construction of the present invention has improvement in reliability in keeping the tail pipe stably fixed to the exhaust pipe, does not deteriorate in its external appearance, and can be manufactured at a low cost.

DETAILED DESCRIPTION OF THE PREFERRED EMBODIMENTS

First Embodiment

Figure 1:
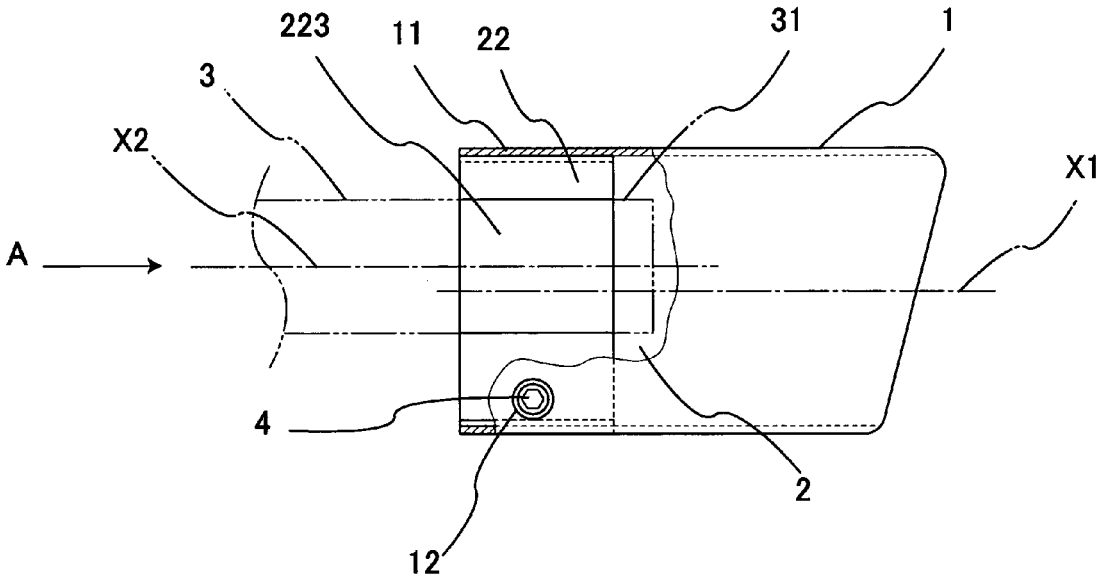
FIG. 1 is a broken-out side view of a tail pipe, showing a first embodiment.
Figure 2:
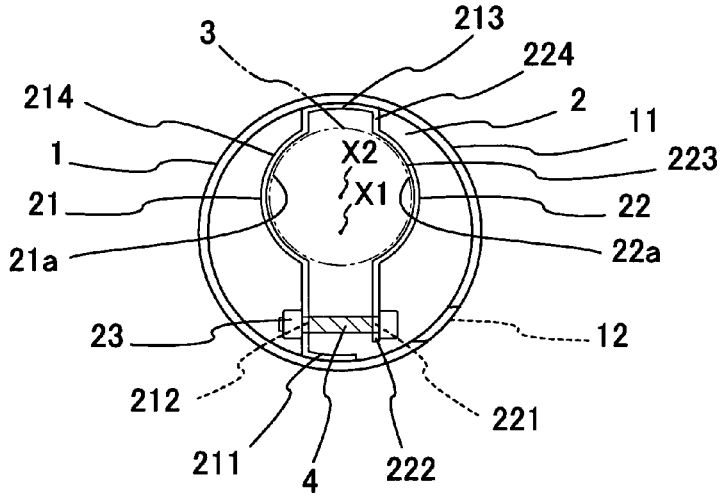
FIG. 2 is a front view of the tail pipe taken along an arrow A of FIG. 1, showing the first embodiment.

In the first embodiment, a clamping means is realized by a clamping member separate from a tail pipe. FIG. 1 is a broken-out side view showing a tail pipe 1. FIG. 2 is a front view of the tail pipe 1 viewed from a front-end opening thereof (in the direction shown with the arrow A of FIG. 1). As shown in FIGS. 1 and 2, a clamping member 2 is mounted inside a front-end open portion 11 of the cylindrical tail pipe 1 formed parallel with the exhaust pipe 3. The clamping member 2 formed by bending a plate having a constant width has plate parts 21, 22 at right and left positions spaced at a certain interval inside the front-end open portion 11. A lower-end portion 211 of the plate part 21 is bent along an inner peripheral surface of the bottom portion of the tail pipe 1 and connected thereto by spot welding. A bolt insertion opening 212 is formed on the plate part 21 in penetration through a position thereof near the lower end thereof. A weld nut 23 constituting the connection member of the present invention is disposed on an outer surface of the plate part 21, with the weld nut 23 coincident with the bolt insertion opening 212. An upper-end portion 213 of the plate part 21 continuous with an upper end 224 of the plate part 22 is bent along the inner peripheral surface of the tail pipe 1. The upper-end portion 213 is connected to the inner peripheral surface of the top portion of the tail pipe 1 by spot welding.

A lower end 222 of the plate part 22 is not connected to the inner peripheral surface of the tail pipe 1 but formed as a free end. A bolt insertion opening 221 is formed on the plate part 22 in penetration through a position thereof corresponding to the bolt insertion opening 212. Confronting intermediate portions of the plate parts 21, 22 are formed concavely in the shape of a circular arc in opposite directions to form circular arc-shaped concave portions 214, 223. The concave portions 214, 223 extend along an axis x1 of the tail pipe 1. The inner peripheral surface of the concave portion 214 and that of the concave portion 223 are formed as concave surfaces 21*a*, 22*a* respectively having a curvature conforming to that of the peripheral surface of the exhaust pipe 3. A bolt insertion opening 12 is formed on the peripheral surface of the front-end open portion 11 of the tail pipe 1 in penetration through a position thereof corresponding to the bolt insertion opening 221.

In mounting the tail pipe 1 having the above-described construction on the exhaust pipe 3, the rear-end open portion 31 of the exhaust pipe 3 is inserted between the concave portion 214 of the right plate part 21 of the clamping member 2 and the concave portion 223 of the left plate part 22 thereof. After a bolt 4 constituting the connection member of the present invention is inserted into the tail pipe 1 from the bolt insertion opening 12, the bolt 4 is penetrated through the bolt insertion openings 212, 221 to screw the bolt 4 into the weld nut 23 of the clamping member 2. When the bolt 4 is tightened, the lower-end 222 of the plate part 22 moves toward the plate part 21. As a result, the interval between the plate parts 21 and 22 becomes shorter, and the rear-end open portion 31 of the exhaust pipe 3 is sandwiched between the concave surface 21*a* of the concave portion 214 and the concave surface 22*a* of the concave portion 223. Thereby the tail pipe 1 is mounted on the exhaust pipe 3 with the axis x1 of the tail pipe 1 disposed parallel with the axis x2 of the exhaust pipe 3.

Figure 3:
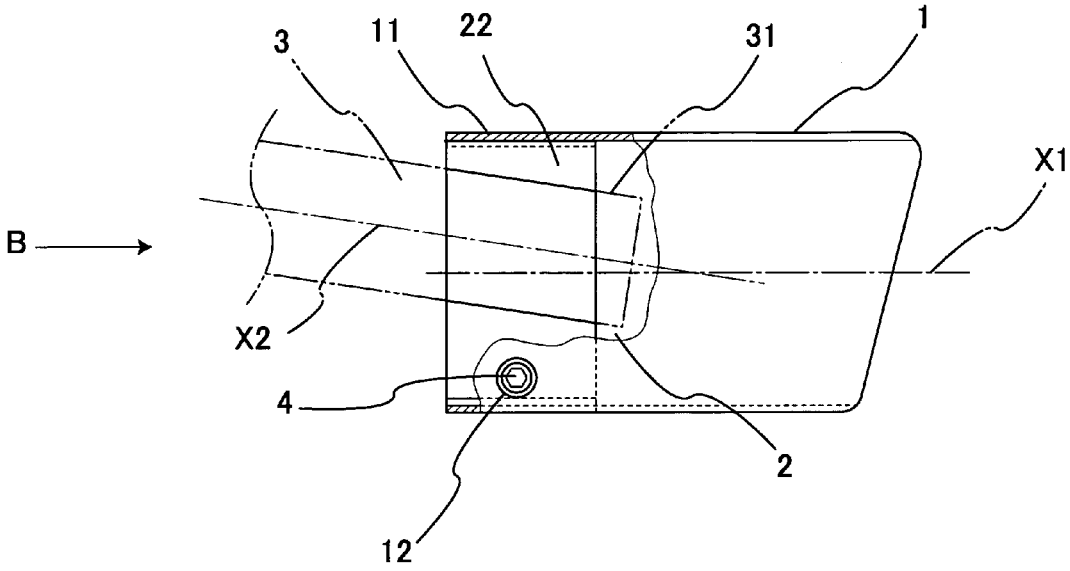
FIG. 3 is a broken-out side view of the tail pipe, showing the first embodiment.
Figure 4:
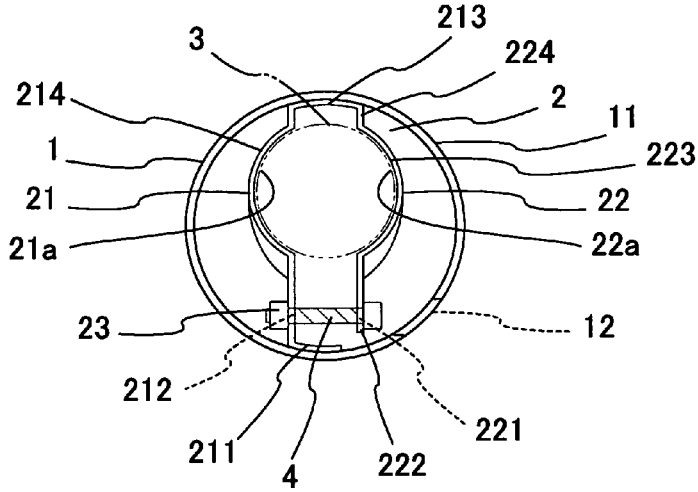
FIG. 4 is a front view of the tail pipe taken along an arrow B of FIG. 3, showing the first embodiment.

FIGS. 3 and 4 show the construction of the tail pipe 1 which is horizontally mounted on the exhaust pipe 3 tilting downward toward its rear end. In this case, the concave portion 214 of the plate part 21 of the clamping member 2 and the concave portion 223 of the plate part 22 thereof are formed to extend along the axis x2 of the exhaust pipe 3 inclining with respect to the axis x1 of the tail pipe 1. In the direction of the axis x2, the inner peripheral surface of the concave portion 214 and the inner peripheral surface of the concave portion 223 are formed as concave surfaces 21*a* and 22*a* respectively having a curvature conforming to that of the peripheral surface of the exhaust pipe 3.

Similarly to the first embodiment described above, the exhaust pipe 3 is inserted between the concave portion 214 of the right plate part 21 and the concave portion 223 of the left plate part 22. Then the bolt 4 is inserted into the tail pipe 1 from the bolt insertion opening 12 to screw the bolt 4 into the weld nut 23. By tightening the bolt 4, the rear-end open portion 31 of the exhaust pipe 3 is sandwiched between the concave surface 21*a* of the concave portion 214 and the concave surface 22*a* of the concave portion 223. Thereby the tail pipe 1 is mounted horizontally on the exhaust pipe 3 with the axis x1 of the tail pipe 1 intersecting with the axis x2 of the tilted exhaust pipe 3.

In the mounting construction of the first embodiment, because the bolt 4 is inserted into the tail pipe 1 and not projected outward from the tail pipe 1, the bolt 4 is prevented from interfering with obstacles. The tail pipe 1 is mounted on the exhaust pipe 3 by connecting the right and left plate parts 21 and 22 to each other with the bolt 4 by elastically deforming the right and left plate parts 21 and 22 in such a way that the interval between the plate parts 21 and 22 becomes shorter and by sandwiching the exhaust pipe 3 between the concave surface 21*a* of the concave portion 214 and the concave surface 22*a* of the concave portion 223. Therefore the mounting construction has improvement in reliability in keeping the tail pipe 1 stably fixed to the exhaust pipe 3. Particularly in the first embodiment, the plate parts 21, 22 are connected to each other with the bolt 4 by elastically deforming the plate parts 21, 22 in such a way as to reduce the interval between them. Therefore owing to the restoring force of the plate parts 21, 22, it is possible to prevent the bolt 4 from being loosened by vibrations. Further because no connection portions to be welded are formed on the mounting construction, there is no possibility of generation of rust. Thus there is no problem of deterioration of the external appearance of the tail pipe 1. Furthermore the tail pipe 1 can be mounted on the tilted exhaust pipe 3 at its rear end with ease and at a low cost by tilting the concave portions 214, 223 of the plate parts at a certain angle with respect to the axis x1 of the tail pipe 1.

Second Embodiment

Figure 5:
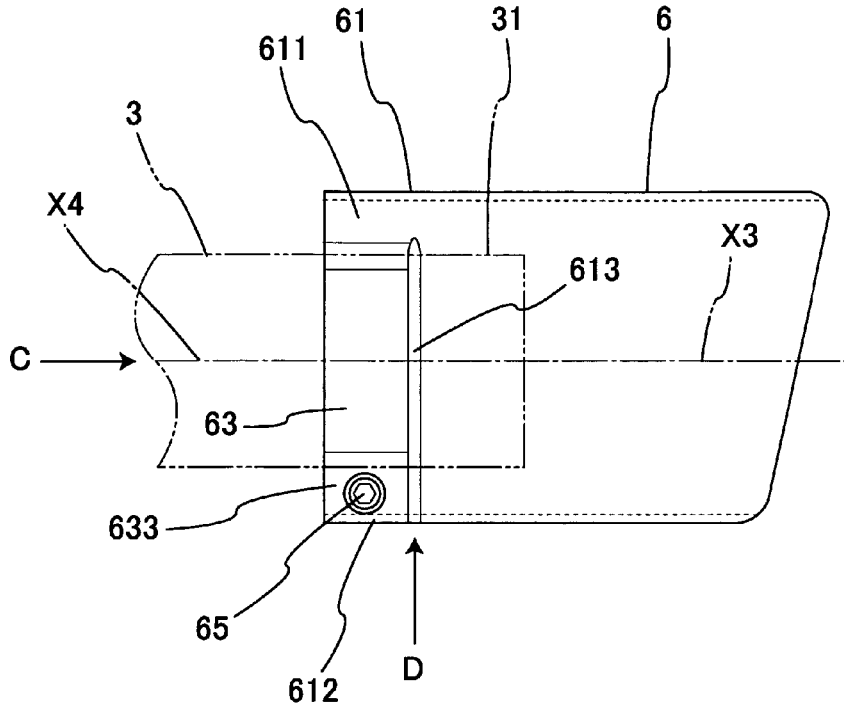
FIG. 5 is a side view of a tail pipe, showing a second embodiment.
Figure 6:
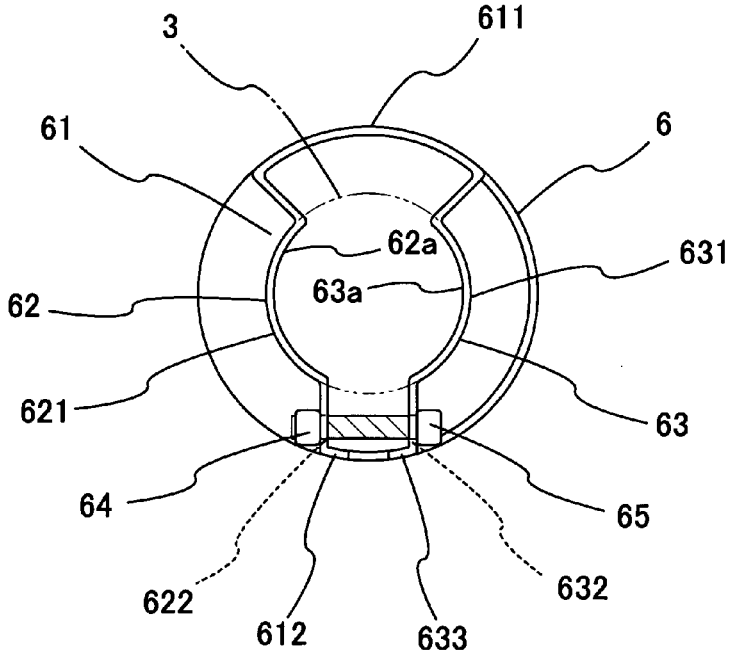
FIG. 6 is a front view of the tail pipe taken along an arrow C of FIG. 5, showing the second embodiment.
Figure 7:
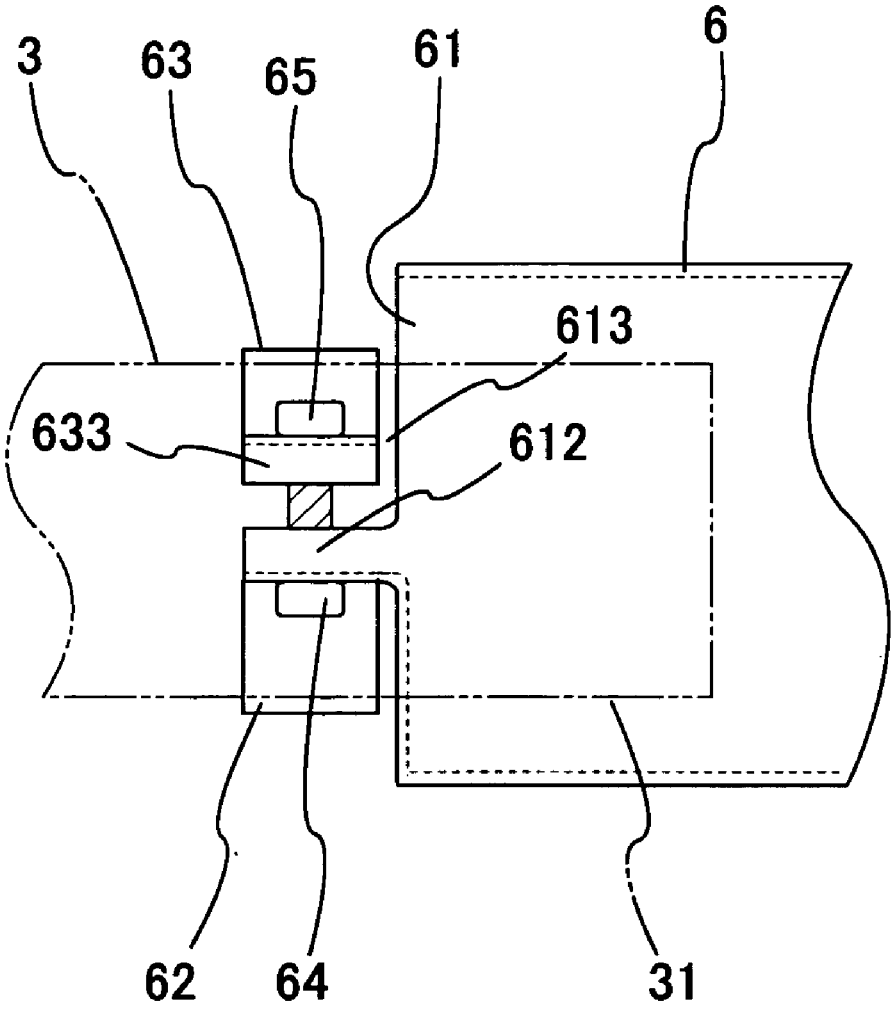
FIG. 7 is a bottom view of the tail pipe taken along an arrow D of FIG. 5, showing the second embodiment.
Figure 8:
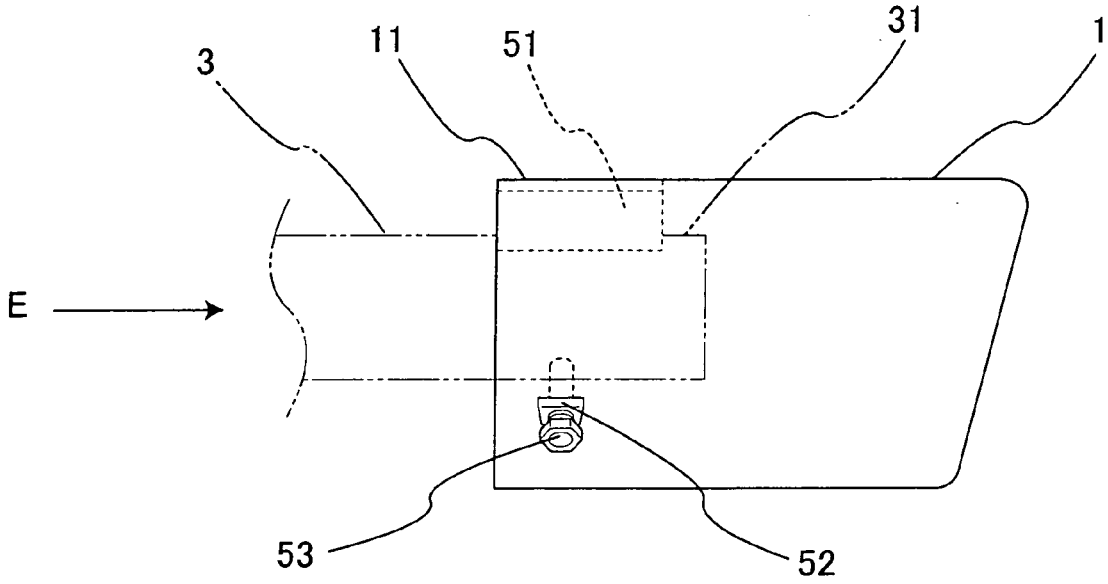
FIG. 8 is a side view of a tail pipe, showing a conventional tail pipe-mounting construction.
Figure 9:
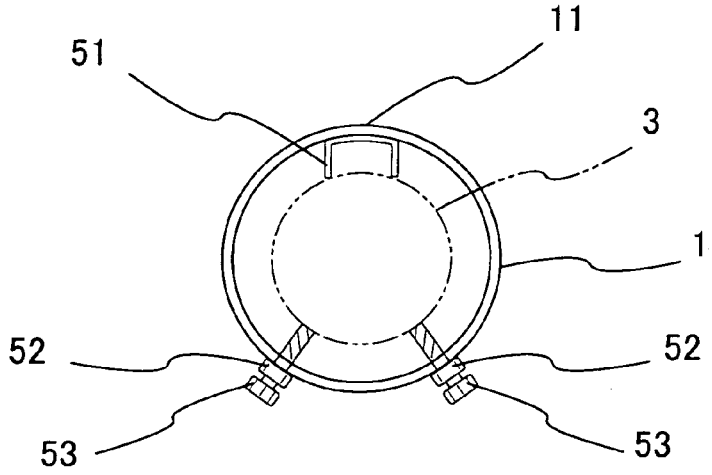
RELATED ART FIG. 9
FIG. 9 is a front view of the tail pipe taken along an arrow E of FIG. 8.
Figure 10:
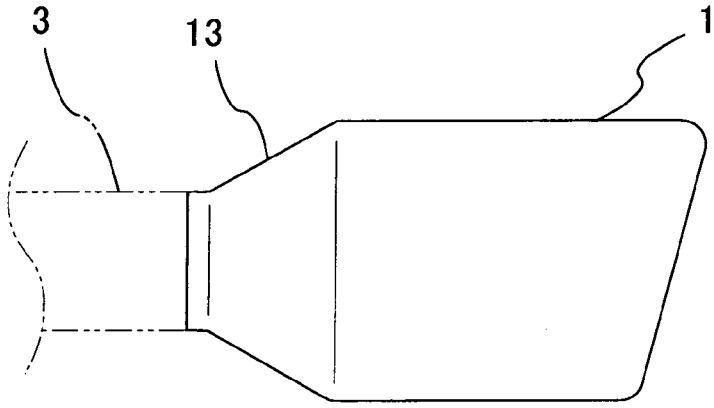
FIG. 10 is a side view of a tail pipe, showing another conventional tail pipe-mounting construction.
Figure 11:
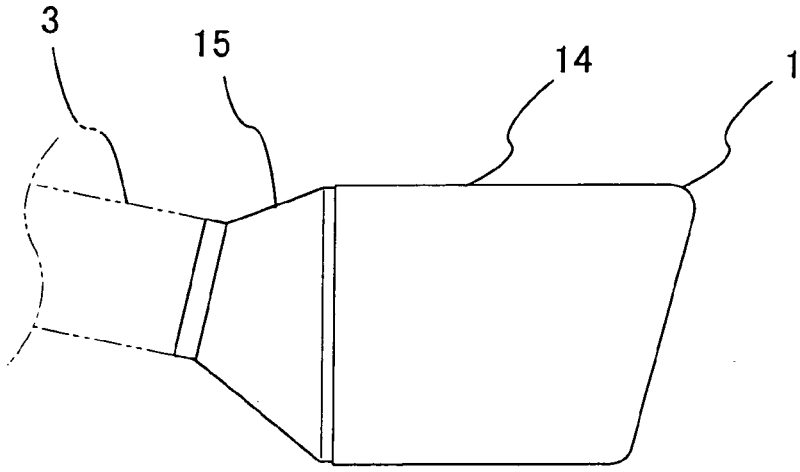
RELATED ART FIG. 11
FIG. 11 is a side view of a tail pipe, showing still another conventional tail pipe-mounting construction.

In the second embodiment, a part of a tail pipe is molded to form a clamping means. FIG. 5 is a side view of a tail pipe 6. FIG. 6 is a front view of the tail pipe 6 viewed from a front-end opening thereof (in the direction shown with the arrow C of FIG. 5). FIG. 7 is a bottom view of the tail pipe 6 viewed from a lower side of the tail pipe 6 (in the direction shown with the arrow D of FIG. 5). As shown in FIG. 6, a top portion 611 having a certain width in the right-to-left direction of the tail pipe 6 is formed in a front-end open portion 61 of the tail pipe 6. One region approximately half of the entire circumferential wall of the front-end open portion 61 is concave inward as a whole in the radial direction of the tail pipe 6 to form a plate part 62 constituting the clamping means of the present invention integral with the tail pipe 6. The other region approximately half of the entire circumferential wall of the front-end open portion 61 is separated from the plate part 62 by a cut-out 613 formed from a bottom portion 612 of the peripheral wall of the front-end open portion 61 to the top portion 611 thereof to form a plate part 63 constituting the clamping means of the present invention having a certain width. The plate part 63 is concave inward as a whole in the radial direction of the tail pipe 6, as shown in FIG. 6. Thereby the upper end of the plate part 63 is continuous with the top portion 611 of the front-end open portion 61 and fixed thereto, and a lower end 633 of the plate part 63 is formed as a free end.

An intermediate portion 621 of the plate part 62 and an intermediate portion 631 of the plate part 63 are formed concavely outward in the shape of a circular arc in the radial direction of the tail pipe 6. The concave portions 621, 631 extend along an axis x3 of the tail pipe 6. The inner peripheral surface of the concave portion 621 and that of the concave portion 631 are formed as concave surfaces 62*a*, 63*a* respectively having a curvature conforming to that of the peripheral surface of the exhaust pipe 3. A bolt insertion opening 622 is formed on the surface of the plate part 62 in penetration through a position near the lower end thereof. A weld nut 64 constituting the connection member of the present invention is formed on the outer surface of the plate part 62, with the weld nut 64 coincident with the bolt insertion opening 622. A bolt insertion opening 632 is formed on the surface of the plate part 63 in penetration through a position corresponding to the bolt insertion opening 622.

In mounting the tail pipe 1 having the above-described construction on the exhaust pipe 3, the rear-end open portion 31 of the exhaust pipe 3 is inserted between the concave portion 621 of the right plate part 62 and the concave portion 631 of the left plate part 63. After a bolt 65 constituting the connection member of the present invention is inserted into the tail pipe 6, the bolt 65 is penetrated through the bolt insertion openings 622, 632 to screw the bolt 65 into the weld nut 64. When the bolt 65 is tightened, the lower-end 632 of the plate part 63 moves toward the plate part 64. As a result, the interval between the plate parts 62 and 63 becomes shorter, and the rear-end open portion 31 of the exhaust pipe 3 is sandwiched between the concave surface 62*a* of the concave portion 621 and the concave surface 63*a* of the concave portion 631. Thereby the tail pipe 6 is mounted on the exhaust pipe 3 with the axis x3 of the tail pipe 6 parallel with an axis x4 of the exhaust pipe 3.

In the mounting construction of the second embodiment, because a part of the tail pipe is molded to form the clamping means, it is possible to realize the reduction of the number of component parts and the cost. The tail pipe 6 is mounted on the exhaust pipe 3 by connecting the right and left plate parts 63 and 62 to each other with the bolt 65 by elastically deforming them in such a way that the interval between the plate parts 63 and 62 becomes shorter and by sandwiching the exhaust pipe 3 between the concave surface 63*a* of the concave portion 63 and the concave surface 62*a* of the concave portion 62. Therefore the mounting construction has improvement in reliability in keeping the tail pipe 6 stably fixed to the exhaust pipe 3. In the second embodiment, the plate parts 62, 63 are connected to each other with the bolt 65 by elastically deforming the plate parts 62, 63 in such a way as to reduce the interval between them. Therefore owing to the restoring force of the plate parts 62, 63, it is possible to prevent it is possible to prevent the bolt 65 from being loosened by vibrations. Further because no connection portions to be welded are formed on the mounting construction, there is no possibility of generation of rust. Thus there is no problem of deterioration of the external appearance of the tail pipe 1.

What is claimed is:

1. A mounting construction for mounting a tail pipe on a rear-end open portion of an exhaust pipe, the tail pipe having a diameter larger than a diameter of said rear-end open portion of the exhaust pipe, the mounting construction comprising:

clamping means for clamping a periphery of said rear-end open portion of said exhaust pipe, the clamping means being provided at a front-end open portion of said tail pipe, said clamping means including a clamping member, separate from said tail pipe, accommodated inside said front-end open portion and sandwiching a periphery of said rear-end open portion of said exhaust pipe;

wherein said clamping means has a pair of plate parts disposed at right and left positions of said front-end open portion and a connection member for connecting said plate parts to each other by reducing an interval between said opposed plate parts enough to sandwich a periphery of said rear-end open portion between a pair of said plate parts;

wherein both ends of one of said plate pair part is fixed to an inner peripheral wall of said front-end open portion, and one end of the other of said plate pair part is fixed to said inner peripheral wall of said front-end open portion, and the other end formed as a free end of said other plate part is connected to said one plate part with a connection member; and wherein said connection member has a nut and a bolt screwed into said nut; and said bolt is inserted into said tail pipe from an open portion formed on a peripheral surface of said tail pipe in penetration therethrough.

2. A mounting construction according to claim 1, wherein a concave surface whose configuration conforms to that of a periphery of said rear-end open portion which is inserted between said plate parts is formed on each of said plate parts.

3. A mounting construction according to claim 2, wherein an axis of said concave surface formed on said plate parts respectively is tilted with respect to an axis of said tail pipe.

4. A mounting construction according to claim 1, wherein said clamping means is realized by a peripheral wall of said front-end open portion being so shaped as to be capable of clamping a periphery of said rear-end open portion of said exhaust pipe.

5. A mounting construction according to claim 1, wherein one of said plate pair part is formed by bending a portion of a peripheral wall of said front-end open portion; and except one end of the other of said plate pair part, said other plate part is separated from said peripheral wall of said front-end open portion by a cut-out formed on said peripheral wall, with separated other end of said other plate part serving as a free end in connection with said one plate part by said connection member.

* * * * *